US005195289A

United States Patent [19]

LaLonde et al.

[11] Patent Number: 5,195,289

[45] Date of Patent: Mar. 23, 1993

[54] TRIM SYSTEM FOR SUSPENSION CEILINGS

[75] Inventors: Paul D. LaLonde, Avon; J. Wesley Sroub, Parma; James A. Fletterick, Olmsted Falls, all of Ohio

[73] Assignee: USG Interiors, Inc., Chicago, Ill.

[21] Appl. No.: 708,975

[22] Filed: May 31, 1991

[51] Int. Cl.[5] ..... E04B 5/52

[52] U.S. Cl. ..... 52/484; 52/488; 52/718.01; 52/822

[58] Field of Search ..... 52/484, 488, 489, 475–477, 52/821, 822, 823, 824, 825, 826, 827, 828, 829, 830, DIG. 8, 716, 717.1, 718.1, 664

[56] References Cited

U.S. PATENT DOCUMENTS

| | | | |
|---|---|---|---|
| 3,501,186 | 3/1970 | Wilcox et al. | 52/822 X |
| 3,546,842 | 12/1970 | Bloom | 52/484 X |
| 3,583,119 | 6/1971 | Kann | 52/484 X |
| 3,834,102 | 9/1974 | Adams | 52/DIG. 8 |
| 3,936,990 | 2/1976 | Garrison, Jr. et al. | 52/717.1 |
| 3,983,600 | 10/1976 | Smith | 52/717.1 X |
| 4,055,930 | 11/1977 | Weinar et al. | 52/717.1 |
| 4,452,021 | 6/1984 | Anderson | 52/484 X |
| 4,742,662 | 5/1988 | Smith | 52/DIG. 8 |
| 4,744,188 | 5/1988 | Ahren | 52/484 |

*Primary Examiner*—Richard E. Chilcot, Jr.
*Attorney, Agent, or Firm*—Pearen, Gordon, McCoy & Granger

[57] ABSTRACT

A support system for trimming exposed edges of suspension ceilings provides a trim strip mounting clip which mounts on the bulb of an adjacent grid tee member and provides a face portion which snaps into and locks with a channel-shaped trim strip. The connector clip supports the trim strip from the adjacent grid members without any exposed fasteners and provides an uninterrupted finished edge appearance. Several embodiments of connector clips are illustrated, one of which provides a support portion pivotally connected to a face portion so that trim strips can be mounted on adjacent grid members in positions parallel to the adjacent grid members and at angles relative thereto.

24 Claims, 9 Drawing Sheets

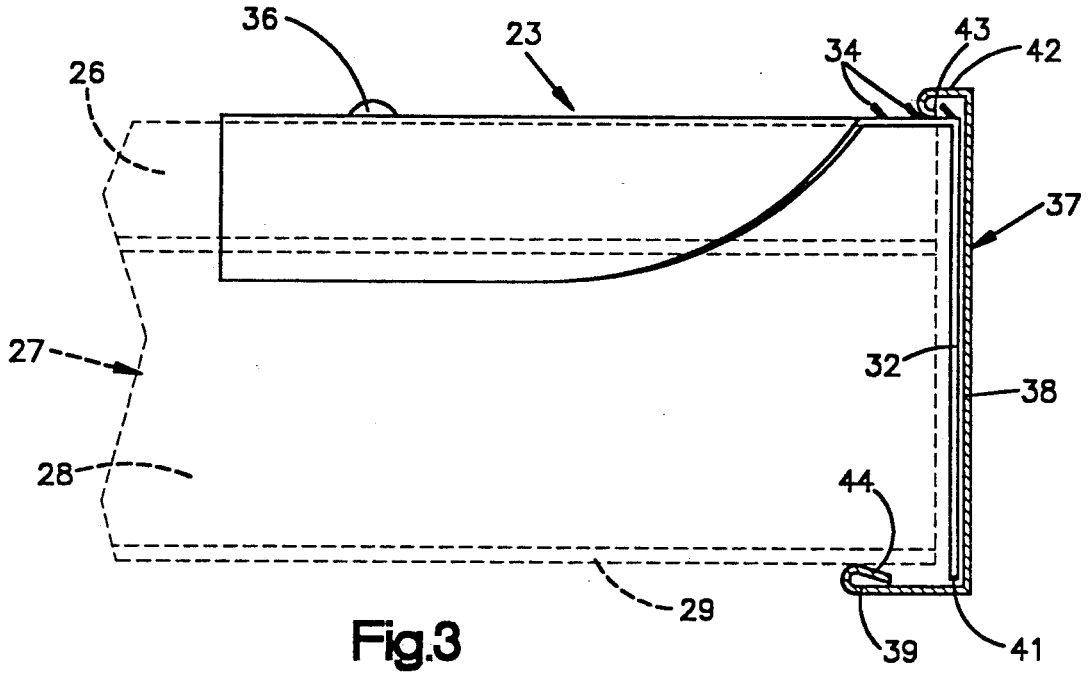
Fig.3
Fig.4
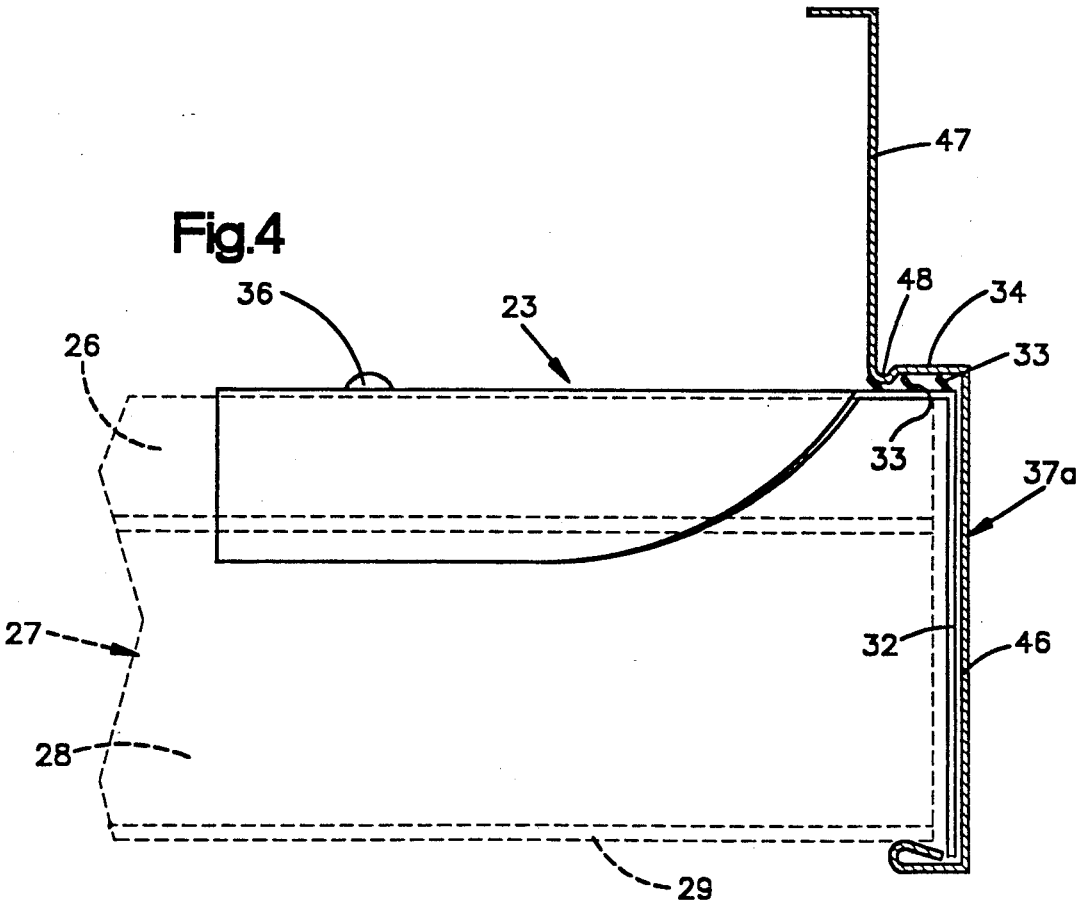

TRIM SYSTEM FOR SUSPENSION CEILINGS

BACKGROUND OF INVENTION

This invention relates generally to suspension ceilings and more particularly to a novel and improved system for providing trim along exposed edges of such suspension ceilings.

PRIOR ART

In some instances, suspension ceilings have exposed edges which require trim if a neat and finished appearance is required. For example, some suspension ceilings are provided with islands which are suspended at levels different than and usually below the adjacent ceiling surface. Such islands have exposed edges spaced from other portions of the ceiling and the walls. If such exposed edges are not trimmed in some manner, a very unfinished appearance results.

In other instances, the ceiling may be terminated at a location spaced from the wall or at a location where an adjacent wall does not exist. Here again, unless a finishing trim is not provided, an unfinished edge may be visible.

In the past, exposed edges have generally been trimmed in one of two ways. One such method of trimming the edge involves the construction of a soffit-type stub wall extending down from the building structure above to the level of the ceiling edge. The suspension ceiling is then installed in the typical manner extending to such stub wall. In such method the soffit itself, which must be separately constructed and supported by the building structure, provides the trim for what would be otherwise an exposed edge of the suspension ceiling. In the other method a trim strip which may be, for example, a channel or L-shaped strip is secured to the lower face of the grid by rivets or screws. Both of these methods are labor intensive and therefore costly. Further, in the latter method, the rivets or screws are exposed to view and therefore detract from the finished appearance of the ceiling.

It is also known to provide a trim strip as illustrated in the U.S. Pat. No. 4,744,188 (assigned to the assignee of this invention). Such trim strip is generally channel-shaped and provides a lower leg which fits under the flange of the grid tee. The upper leg of such channel is secured to the bulb of the grid tee. Such trim strips can only be installed along exposed edges of the ceiling where a grid tee member extends parallel to the edge and cannot be installed at angles to the ceiling grid, nor at locations where only the ends of grid tees exist at the exposed edge. Such patent is incorporated by reference in its entirety.

SUMMARY OF THE INVENTION

The present invention provides a cost efficient system for mounting edge trim along exposed edges of suspension ceilings. With such system, the trim is supported and positioned by the ceiling grid itself, therefore it is not necessary to construct separately supported structures to conceal the edge of the ceiling as required in the first method described above.

Further, the system provides a connector which supports the trim from the ceiling grid without any exposed fasteners so that the finished appearance of the trim is not degraded by any exposed fasteners of the like.

Still further, the trim can be installed and supported by the grid members in positions in which the trim extends parallel to or at an angle with respect to the support grid.

In a first illustrated embodiment a simple, low cost connector clip is provided with a channel-shaped support portion which fits over the bulb of a suspension ceiling grid tee and also provides a face portion which snaps into a channel-shaped trim strip. Such connector is easily installed at the ends of the grid tees along the exposed edge of the suspension ceiling. The completion of the trim installation is accomplished by merely snapping a trim channel onto the face portion. This illustrated embodiment may be used when the trim strip extends perpendicular to the supporting grid tee and the trim has a height substantially equal to the height of the grid tee.

In a second embodiment, the connector clip is again provided with a channel-shaped support portion which again fits over the bulb of a typical grid tee. In this embodiment a face portion is connected to the support portion by a connection which allows the face portion to rotate relative to the support portion with a pivot-type movement. Here again, the face portion is structured to connect with a trim strip by a simple snap in connection.

The face portion, because of the pivot-like movement, permits this embodiment to be connected with trim extending parallel to the supporting grid tees as well as at angles relative thereto. In fact, with this embodiment the connector can be used to connect with straight or curved trim strips extending at all angles relative to the associated grid tee from parallel to perpendicular. Further, with this embodiment the face portion can be sized to connect with narrow trim strips having a width substantial equal to the height of the grid tees or with trim strips having a substantially greater height.

A third embodiment provides a simple connector clip for connecting trim strips parallel to the supporting grid tee. This embodiment can connect with trim strips having a height substantially greater than the height of the grid tee.

These and other aspects of this invention are illustrated in the accompanying drawings and are more fully described in the following specification.

BRIEF DESCRIPTION OF THE DRAWINGS

FIG. 3 is a side elevation of the trim mounted clip illustrated in FIG. 2 with the grid on which the clip is mounted illustrated in phantom;

FIG. 4 is a side elevation of the trim mounting clip of FIG. 2 with a relatively wide trim strip mounted thereon;

FIG. 18 illustrates the manner in which a trim strip support clip can be installed with a grid tee having a boxshaped panel supporting flange structure which is open on the lower side thereof;

DETAILED DESCRIPTION OF THE DRAWINGS

Figure 1:
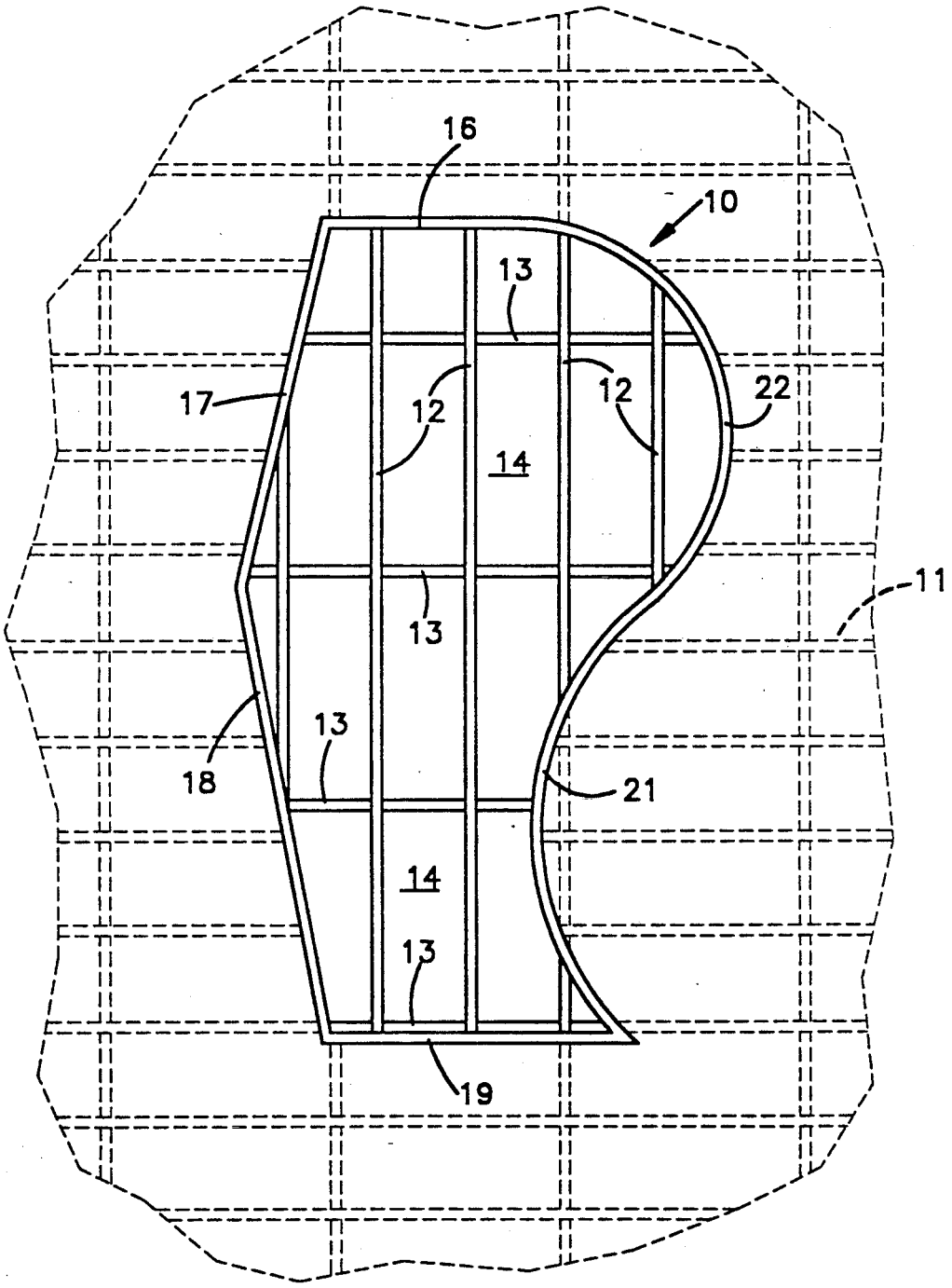
FIG. 1 is a view from below of a suspension ceiling having an island suspended below a main suspension ceiling and provided with trim along the edges thereof mounted in accordance with the present invention.

FIG. 1 illustrates an island 10 positioned below the remainder of a suspension ceiling 11. The suspension ceiling is illustrated in dotted lines to emphasize the fact that the island is displaced below the surface of the ceiling.

The particular island 10, like the ceiling 11, is provided with main grid tees 12 and cross tees 13 which are connected together in the usual manner to form panel receiving openings 14. The entire island is enclosed within channel shaped trim strips which provide a finished edge for the island. In this particular instance a portion of the island is enclosed by straight trim strips 16, 17, 18 and 19. The remainder of the island is enclosed within curved trim strips 21 and 22. The trim strip 21 is concavely curved and the trim strip 22 is convexly curved.

All of these trim strips are mounted on the associated main tees 12 and cross tees 13 by trim strip mounting clips in accordance with the present invention. In FIG. 1 such mounting clips are not visible because they are hidden by the panels and the trim. Further, the mounting clips do not require any exposed fasteners so the trim strips form a finished border around the entire island.

Figure 2:
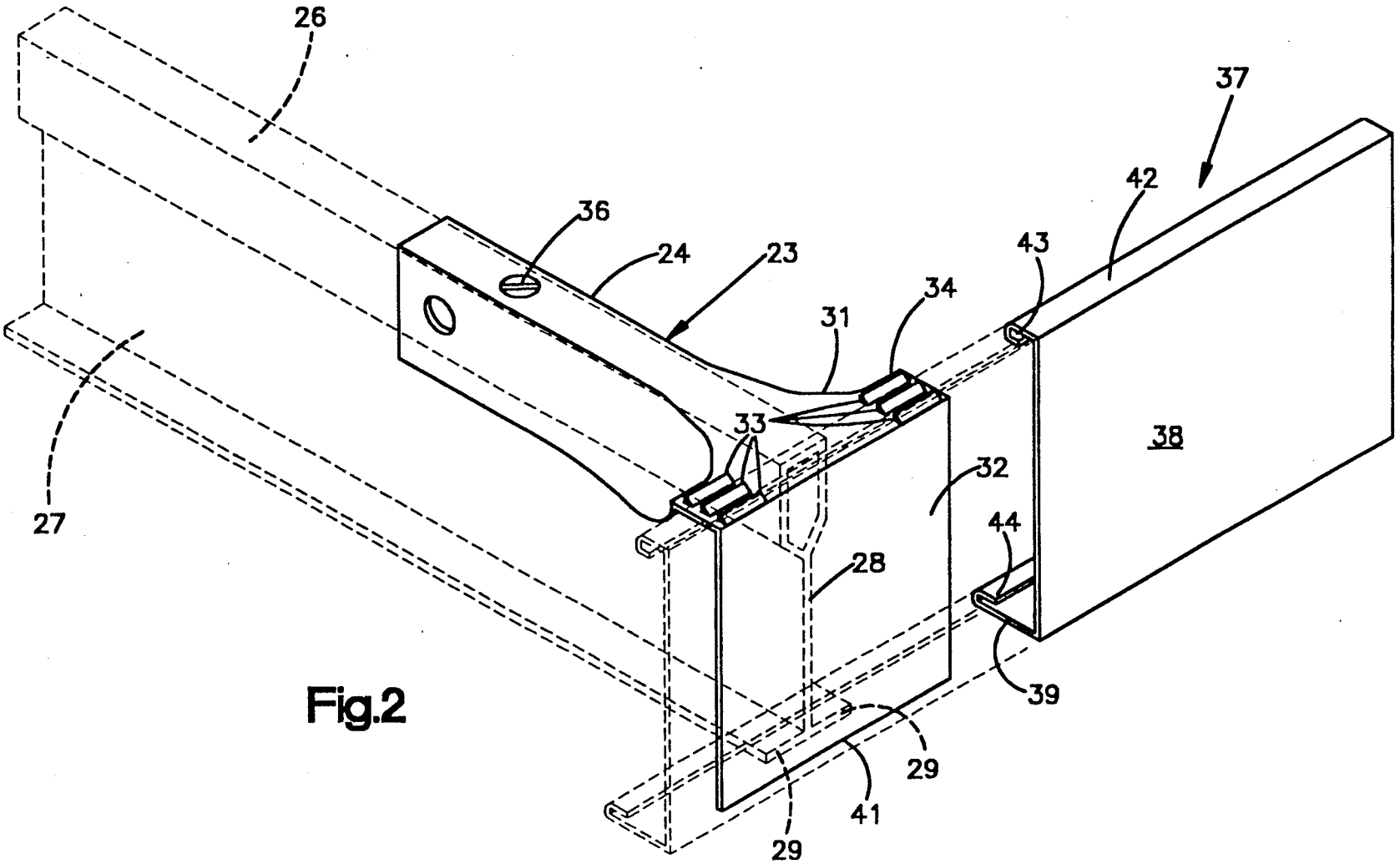
FIG. 2 is a perspective view of a trim mounting clip in accordance with the first embodiment of this invention and one type of trim channel that may be mounted on such clip.
Figure 5:
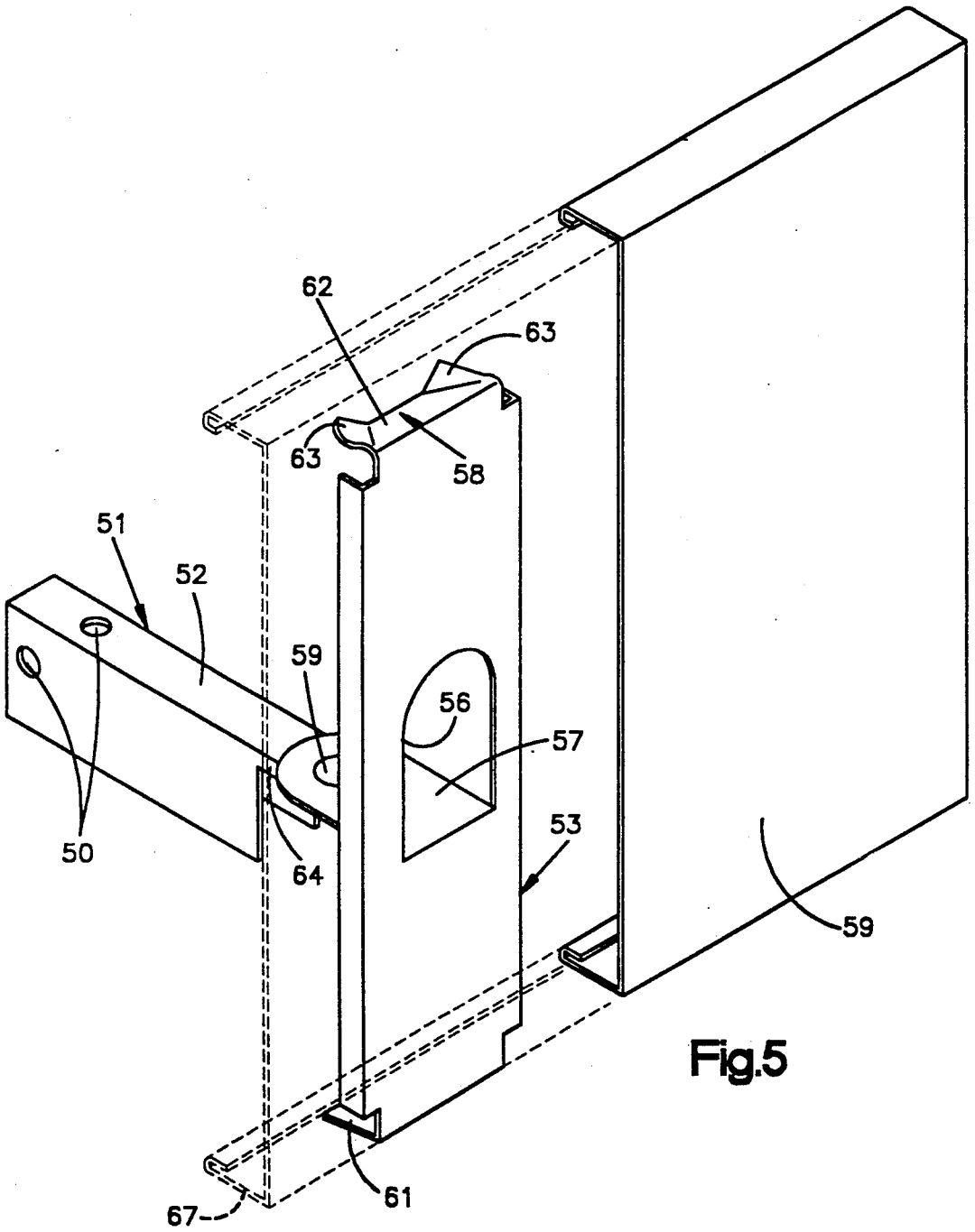
FIG. 5 is a perspective view of a second embodiment trim mounting clip in which the face portion of the clip on which the trim is actually mounted is pivotally connected to the mounting portion allowing mounting of a trim strip which extend at various angles relative to the supporting grid tee.

FIGS. 2 through 4 illustrate a first embodiment of a trim strip mounting clip 23 in accordance with this invention. The mounting clip 23 provides a channel-shaped or inverted U-shaped support portion 24 which fits over the bulb 26 of an associated grid tee 27. Such grid tee, like all of the grid tees illustrated in the various figures, provides a hollow, generally rectangular bulb 26 at the upper edge of a web 28 and oppositely extending panel supporting flanges 29 along the lower edge of the web 28.

A transition portion 31 joins the support portion 24 to a planar face portion 32. Extending from the upper surface of the transition portion 31 are three pairs of locking tabs 33 which are inclined upwardly and rearwardly to locking edges 34. Typically, the support portion 24 is secured to the bulb 26 by a screw or rivet fastener 36 which ensures that the mounting clip 23 cannot move relative to the associated grid tee 27. Preferably, the support portion is punched to provide an opening on the top and the side so that a fastener 36 can be installed in either position. For example, fasteners 36 are installed on the side of the bulb when ceiling clearance prevents them from being installed on the top.

A channel-shaped trim strip 37 is snapped into position on the mounting clip 23 and is therefore secured to and supported by the associated grid tee members. Such trim strip 37 provides a planar portion 38 which fits against the face portion 32 of the mounting clip. A lower flange 39 fits beneath the bottom edge 41 of the face portion and an upper flange 42 fits back along the upper surface of the transition portion 31 of the mounting clip. The upper flange 42 is provided with a hem 43 which locks against one of the pair of locking tabs to hold the upper flange tightly against the upper end of the face portion. Similarly, the lower flange is usually provided with a hem 44, however, such hem need not engage the back side of the lower edge 41 of the face portion 32 since the engagement between the upper hem and the locking edge 34 is spaced back from the face portion and produces a force tending to maintain the lower end of the trim strip tight against the face portion.

In FIGS. 3, 4, and some of the other FIGS., clearances are shown between the mounting clip and the various portions of the trim strip for purposes of illustration. However, in practice, the trim strips are dimensioned to tightly engage the face portion 32 of the mounting clip, in fact, an interference fit is desired so that once the trim strip is snapped into its mounted position, it is tightly held by the mounting clip. The lower flange 39 extends under the adjacent portion of the panel supporting flange 29. Because a hem 44 is provided on the lower flange 39, all raw edges are concealed.

FIG. 4 illustrates the manner in which a trim strip 37*a* having a height exceeding the height of the grid tee 27 may be mounted on a mounting clip 23. In this instance, the trim strip provides a lower portion 46 which snaps onto the face portion of the mounting clip 23 and an upper portion 47 which is rearwardly spaced and extends above the grid tee. In this illustrated trim strip 37*a* a bead 48 is provided at the lower end of the upper portion to lock with the locking tabs. Here again, the mounting of the trim strip is accomplished by merely snapping the trim strip onto the associated mounting clip 23.

The mounting clip 23 can only be used at locations where the trim strip must extend perpendicular to the associated grid tee and the grid tee ends at an off-module position. For example, such a mounting clip 23 could typically be used to connect the trim portion 16 illustrated in FIG. 1 to the ends of the main runners 12. Because the connector 23 is formed from a single piece of sheet metal and is very low in cost, its use is preferred in instances in which the trim strip extends perpendicular to the grid tee and is located at an off-module position.

Figure 6:
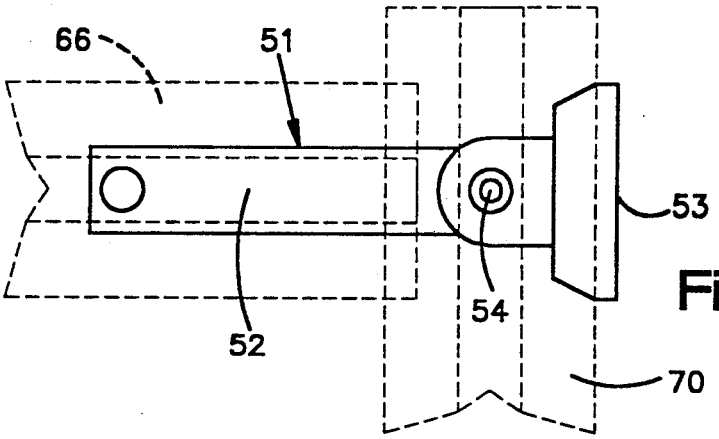
FIG. 6 illustrates the mounting clip of FIG. 5 mounted on a grid at a intersection between perpendicularly extending grid tee members.
Figure 7:
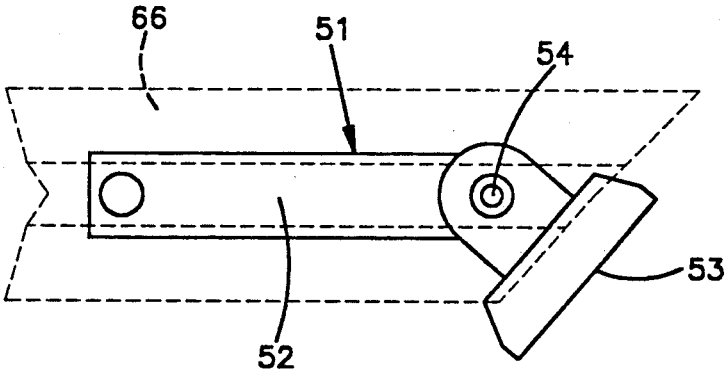
FIG. 7 illustrates the trim mounting clip of FIG. 5 positioned to support a trim strip extending at an angle relative to the grid tee member.
Figure 8:
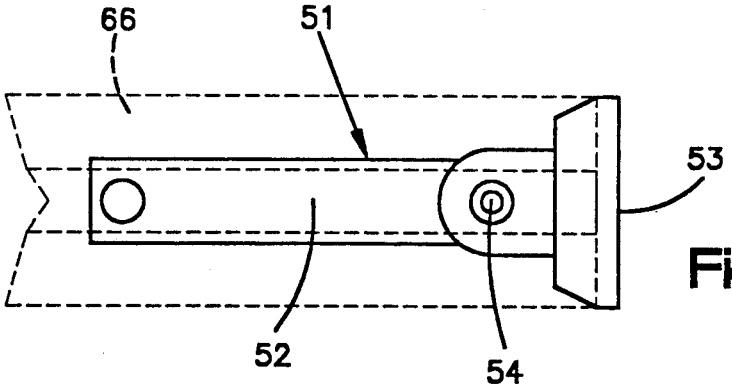
FIG. 8 illustrates the trim strip mounting clip mounted on the end of a grid tee positioned to support a trim strip extending perpendicular to the grid tee.
Figure 9:
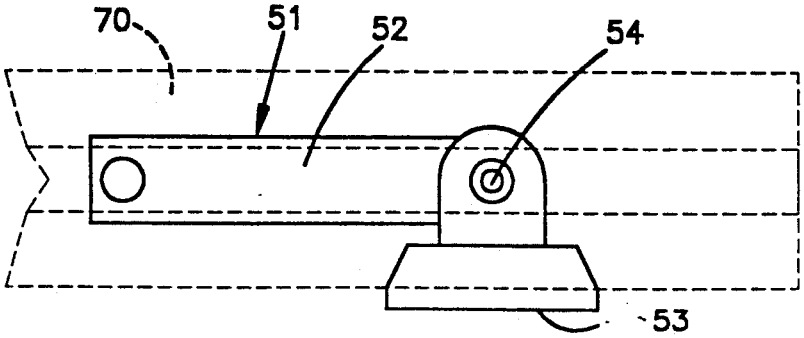
FIG. 9 is a view of the trim strip mounting clip in position to support a trim strip extending parallel to the supporting grid tee.

FIGS. 5 through 14 illustrate variations in structure and use of a second embodiment mounting clip. Such mounting clip may be used to connect straight or curved trim strips of various heights. Further, the mounting clip can be used with trim strips which extend parallel to the supporting grid tee or at angles relative to the supporting grid tee. In this embodiment, all of the variations of the mounting clip 51 provide a support portion 52 which is again channel-shaped or shaped or as an inverted "U" so as to fit down over the bulb of an associated grid tee in a manner similar to the support portion of the first embodiment. A pair of openings 50 are provided in the support portion 52 through which fasteners can be installed. However, in this embodiment the face portion 53 is connected to the support portion by a rivet 54 which permits pivotal movement of the face portion relative to the support portion through a full 180°. Therefore, the face portion 53 can extend perpendicular to the supporting grid tee as illustrated in FIGS. 6 and 8, at an angle relative to the supporting grid tee as illustrated in FIG. 7, or parallel to the supporting grid tee as illustrated in FIG. 9. In the variation illustrated in FIGS. 5 through 12, the face portion 53 is cut out at 56 to provide a laterally extending tongue 57. The tongue 57 extends rearwardly to a position in which it overlays the adjacent end of the support portion and is connected thereto by the rivet 54.

The upper end of the face portion 53 is formed with a rearwardly extending flange 58 which snaps into and locks with the associated trim strip 59. Similarly, the lower end of the face portion 53 is provided with a rearwardly extending flange 61 which snaps into and locks with the lower end of the trim strip 59. Preferably, the upper flange 58 is provided with a recessed, central portion 62 and a pair of upwardly extending lock portions 63. With such structure, a screwdriver or the like can be inserted between the upper flange of an installed trim strip 59 and the recess 62 to pry the upper flange of the trim strip up, clear of the locking projections 63, when it is desired to remove the trim strip from its mounted position.

Figure 10:
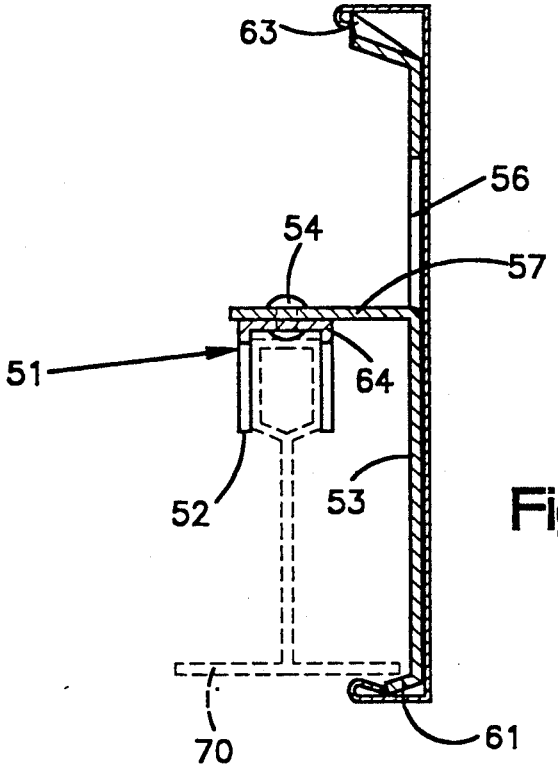
FIG. 10 is a vertical cross section illustrating the trim strip mounting clip supporting a trim strip extending parallel to the grid tee and corresponds to the position illustrated in FIG. 9.
Figure 11:
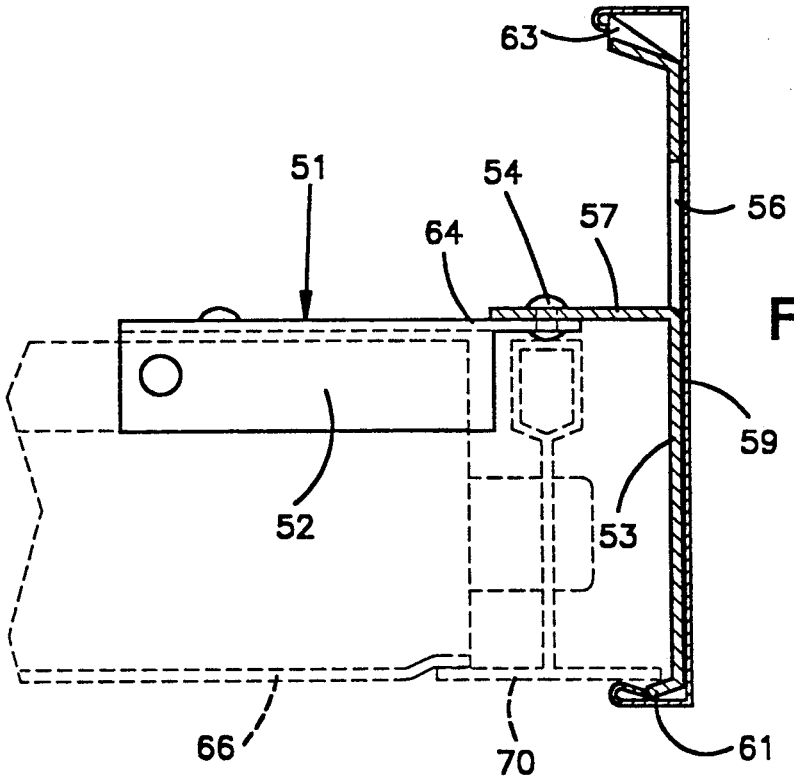
FIG. 11 corresponds to FIG. 6 and illustrates the trim strip mounting clip at an intersection and supporting the trim strip extending parallel to the adjacent grid tee.

The support portion is formed with an end extension 64 which extends beyond the channel-shaped part thereof so that the mounting clip 51 can be installed at an intersection as illustrated in FIGS. 6 and 11. In such instance, the support portion 52 is positioned on a grid member 66 so that the extension 64 extends beyond the end thereof and positions the pivot fastener 54 above the bulb of the grid tee 67. Further, the tongue 57 is sized so that it positions the face portion 53 beyond the adjacent edge of the flange of the grid 70. Therefore, the trim strip 59 is properly positioned to extend parallel to the grid tee 70 even though it is supported by the grid tee 66 and extends perpendicular to the grid tee 66. In FIG. 10 however, the support portion 52 of the mounting clip 51 extends parallel to the adjacent grid member 70 since it is mounted at a location spaced from an intersection. In this mounting, the face portion 53 is pivoted to a position perpendicular to the support portion 52 and the face portion is again properly positioned for supporting a trim strip 59 parallel to the grid tee 67.

The length of the tongue 57 is selected so that when the pivot 54 is directly over the bulb of an adjacent grid tee and the face portion 53 is positioned parallel to such grid tee, the face portion is properly positioned to receive the trim strip. In the illustrated embodiment, the planar surface is spaced from the pivot axis by a distance slightly greater than the width of one of the panel supporting flanges of the grid tee.

The mounting clip, because of the pivoted connection between the face portion and the support portion, can be utilized to support trim strips extending parallel to the supporting grid tee and at all angles between the perpendicular and parallel position. For example, the mounting clip 51 can be used to connect and support any of the trim strips illustrated in FIG. 1.

When mounting the trim strip 16 the mounting portion is positioned with respect to the end of the adjacent grid tees so that the trim strip 16 extends perpendicular to and encloses the end of the associated grid tee in the manner illustrated in FIG. 8. When supporting the angled trim strip 17 and 18, the face portion is pivoted with respect to the support portion to properly align with such trim strips. When supporting the trim strip 19, the mounting clip can be mounted at intersections as illustrated in FIG. 11 or at locations spaced from the intersections as illustrated in FIG. 10. When supporting the curved trim strips 21 and 22, the face portion is appropriately pivoted relative to the supporting grid member to accommodate the particular angle at the point of support. In effect, the mounting clip 51 is a universal mounting clip which can be adjusted to support a trim strip in substantially any orientation with respect to the supporting grid tee member.

Figure 12A:
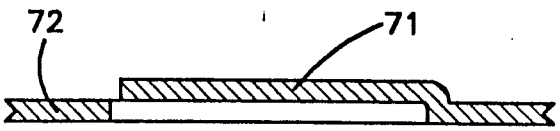
FIG. 12*a* illustrates the tab as initially formed and prior to bending, the tab to the position of FIG. 12.
Figure 12:
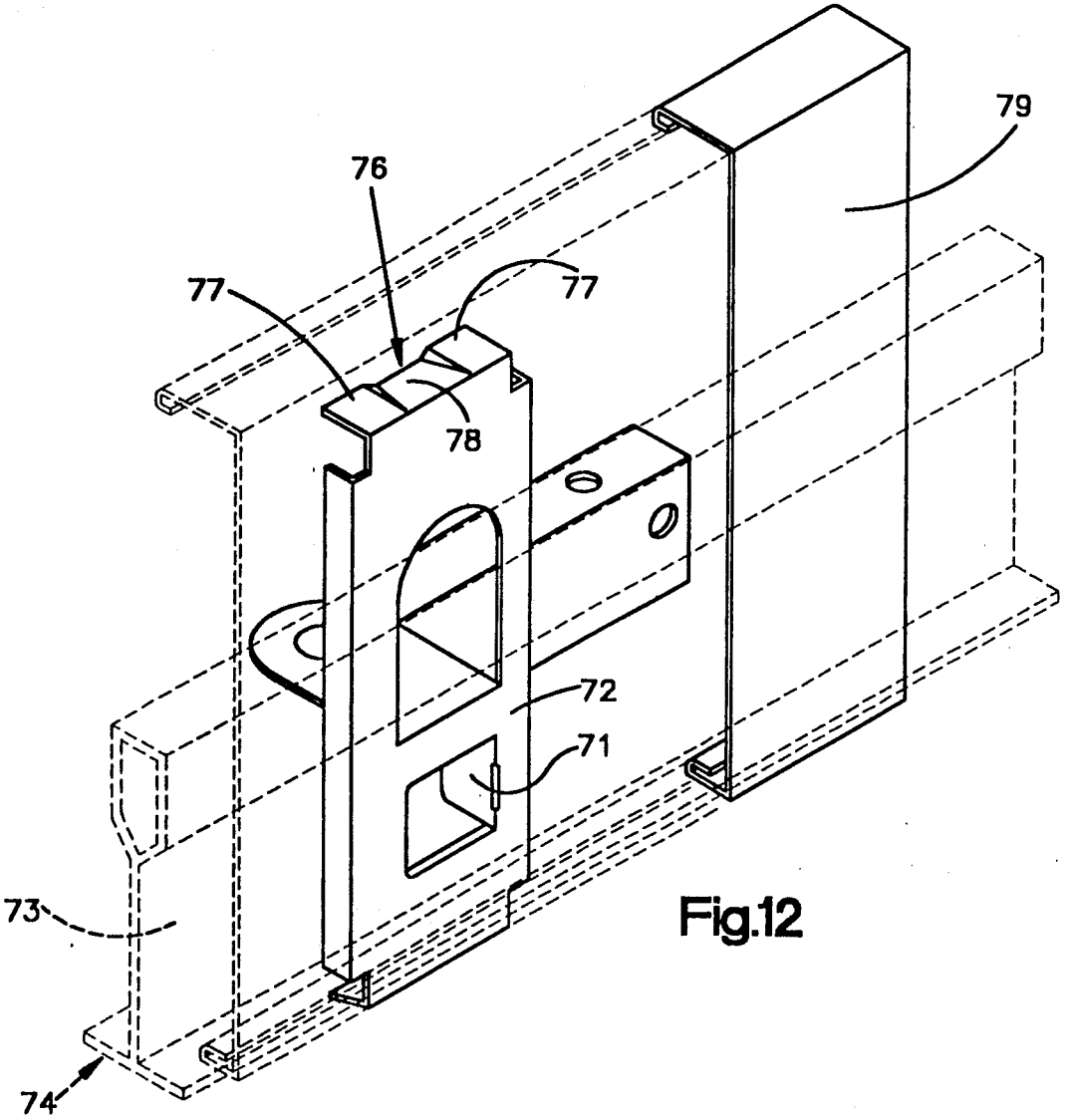
FIG. 12 is a modified embodiment of the trim strip mounting clip of FIGS. 5-11 in which a tab is provided to engage the side of the web of the supporting grid tee when the face portion is pivoted to extend parallel to such grid tee.

FIG. 12 illustrates a variation of the second embodiment. In this variation a second tab 71 is bent back from the face portion 72. This tab 71 is sized and positioned so as to engage with the side of the web 73 of an associated grid tee 74 when the face portion is pivoted to a position parallel to the length of the grid tee 74. This tab provides additional stability. Further, in this variation, the upper flange 76 is modified to provide laterally extending locking edges 77 on either side of the recess 78. This structure provides a greater area of contact with the trim strip 79 than the earlier described flange locking system. Here again the recess permits the insertion of a screwdriver or the like when removal of an installed trim strip is required.

As illustrated in FIG. 12*a*, the tab 71 is lance cut from the face 71 and initially extends parallel to the face portion but is on the back side thereof. When the tab use is not required, it remains in its initial position. However, when the tab use is required, it is merely bent back perpendicular to the face portion as illustrated in FIG. 12.

Figure 13:
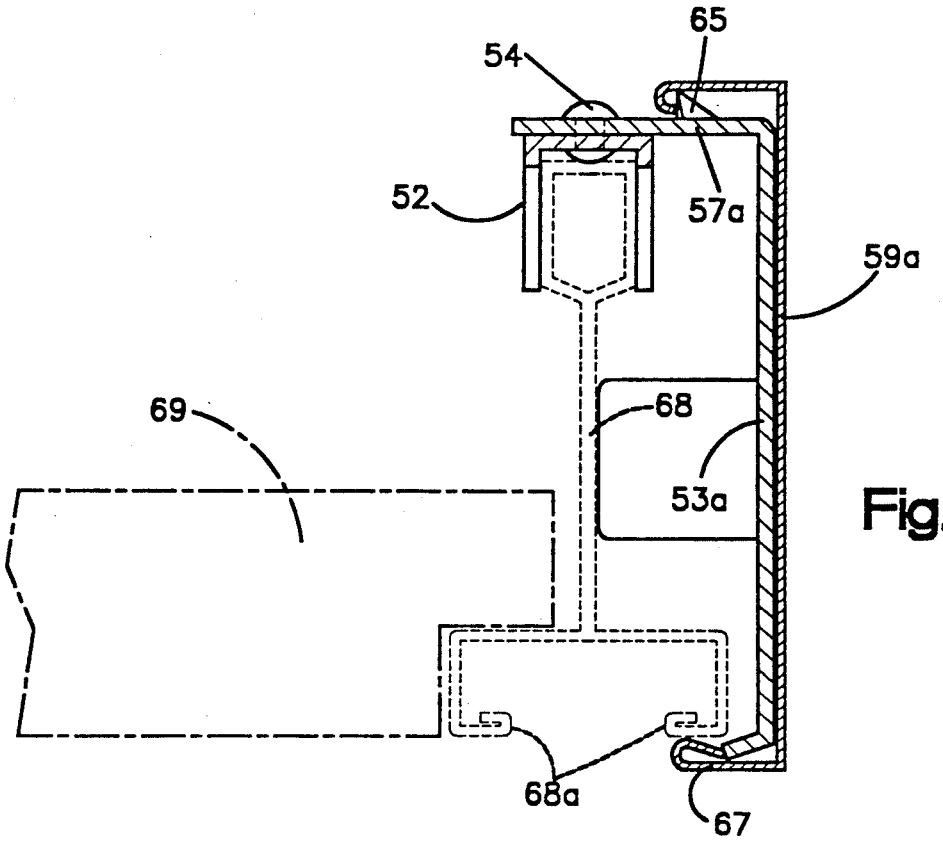
Figure 14:
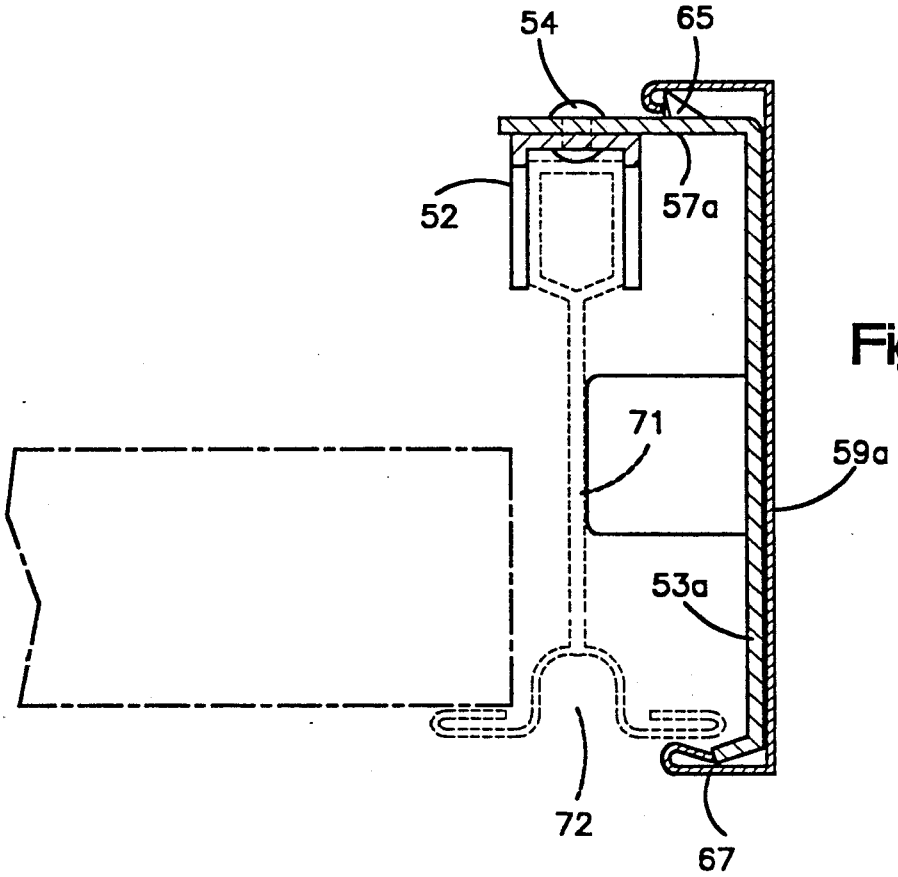
FIG. 14 is a view similar to FIG. 13 but illustrating the manner in which the same trim strip and support clip can be applied to a grid tee having a hat-shaped panel supporting flange.

FIGS. 13 and 14 illustrate another modified version of the second embodiment mounting clip. In this modified version, the trim strip is sized to have a height substantially equal to the height of the associate grid tee. In such instance, the face portion 53*a* is bent to extend laterally providing a lateral flange 57*a* corresponding to the tongue 57 of the version of FIG. 5. Such flange is connected by pivot fastener 54 to the support portion 52. In this instance, a locking tongue 65 is bent out from the flange 57*a* to lock with the upper flange of a trim strip 59*a*.

The various proportions of the mounting clips are selected so that the lower flange 67 of the trim strip 59 or 59*a* will extend a short distance under the lower surface of the flange of a typical grid tee and also so that it will be properly positioned with respect to other forms of grid tees. For example, in FIG. 13, the grid tee 68 is provided with a box-like lower flange which is open on the bottom side.

The grid tee 68 is of the type illustrated in the U.S. Pat. No. 4,535,580 which patent is incorporated herein by reference. Such grid tees provide gaps in the lower inwardly extending lips 68*a*, as described in such patent, so that a "miter" type joint is provided at intersections. Since such gaps would be exposed on the outer side where no intersecting grid tee exists, the lower flange 67 of the trim strip is proportioned and positioned to extend into exact alignment with the inner edge of the outer lip 68*a* as illustrated in FIG. 13. Therefore, the gaps are concealed from view. The tab 71 functions to insure this precise positioning of the flange 68*a*.

The same mounting clip and trim strip 59*a* can also be used with grid tees 71 as illustrated in FIG. 14. Such grid tees provide a hat-shaped flange structure having an upwardly extending central channel 72. In this instance, the lower flange 67 of the trim strip 59*a* again, extends inwardly along the adjacent flange surface but terminates back from the channel 72.

With this pivoted embodiment, the face portion can be made of substantially any height to connect with and support trim strips of various heights. Further, if desired, the face portion can be made wider so as to function as a splice plate at abutting ends of adjacent trim strips.

Figure 15:
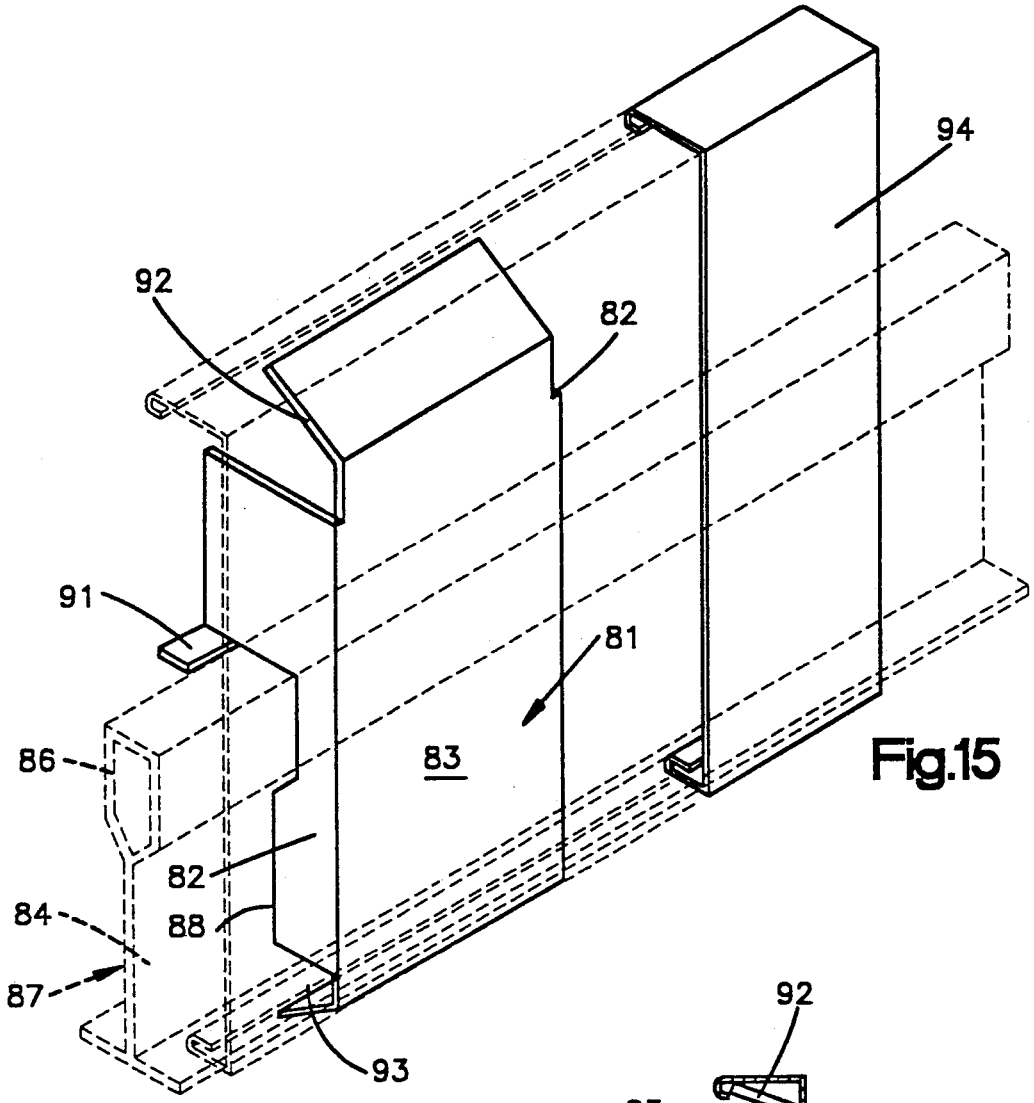
FIG. 15 is a perspective view of another embodiment of a trim strip support clip which is formed of a single piece of sheet metal and may be used to support a trim strip extending parallel to the supporting grid tee.
Figure 16:
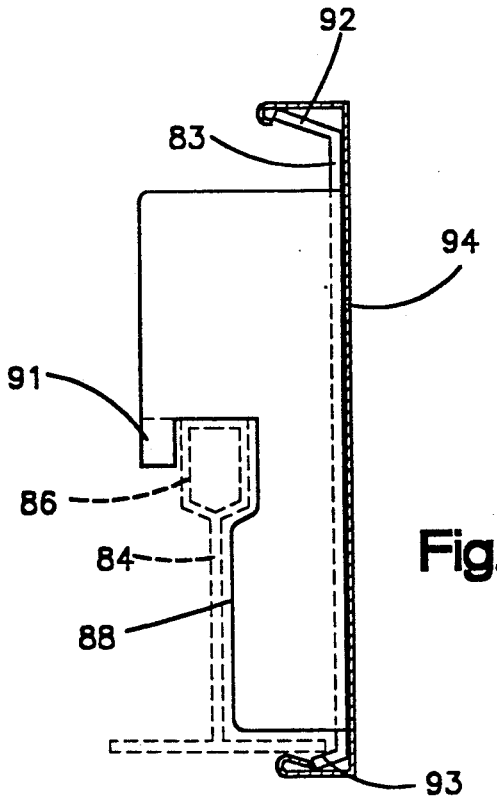
FIG. 16 is an end view of the support clip and trim strip illustrated in FIG. 15.

FIGS. 15 and 16 illustrate a third embodiment of this invention. In this embodiment, the mounting clip 81 is formed of a single piece of sheet metal. A pair of similar legs 82 are bent back from opposite sides of the face portion 83 and are shaped to mate with the web 84 and bulb 86 of the associated grid tee 87. Each leg 82 provides a first edge 88 which engages the side of the web 84. Above the edge 88 the legs are cut to fit around the bulb 86. Tabs 91 are bent up as illustrated in phantom in FIG. 15 to allow the mounting clip to be installed on the associated runner 87 and after the clip is positioned, the tabs 91 are bent down to engage the remote side of the bulb. Here again locking flanges 92 and 93 are provided at the upper and lower ends of the face portion to lock with a channel-shaped trim strip 94. This embodiment can only be used to connect with trim strips extending parallel to the associated grid tee but has the advantage of simplicity since the mounting clip is formed of a simple sheet metal piece bent to produce the required flanges and legs.

In each of the illustrated embodiments, the mounting clip is first mounted on the associated grid tee and the trim strip is thereafter installed by merely snapping it into the mounted position on the mounting clip. Because there are no fasteners required to connect the trim strip to the mounting clips, there are no exposed fasteners which could detract from the finished appearance of the installation. Further, because the mounting clips can be easily installed to support trim strips extending in substantially any direction relative to the associated grid tee, proper trim can be provided for edges of substantially any shape.

Although the preferred embodiments of this invention have been shown and described, it should be understood that various modifications and rearrangements of the parts may be resorted to without departing from the scope of the invention as disclosed and claimed herein.

What is claimed is:

1. A suspension ceiling trim connector for mounting trim strips on grid tee members along exposed edges of suspension ceiling grids formed of interconnected grid tee members having an upstanding central portion and panel supporting flanges extending in opposite directions from the lower edge of said central portion, said trim connector comprising a support portion adapted to be connected to said central portion and a vertically extending face portion, said face portion providing vertically spaced opposed interlocks adapted to connect with channel-shaped elongated trim strips without the use of separate fasteners, said trim connector operating to mount a channel-shaped trim strip on an adjacent grid without any exposed fasteners.

2. A trim connector as set forth in claim 1 wherein said upstanding portion provides a web joined to said flanges along one edge and includes a bulb along the opposite edge of said web, and said support portion is adapted to mount on said bulb.

3. A trim connector as set forth in claim 2 wherein said support portion has an inverted "U" shape adapted to fit along the top and sides of said bulb.

4. A trim connector as set forth in claim 3 wherein said face portion has a height substantially equal to the height of said grid tee members and is adapted to lock into a channel-shaped trim strip having a height substantially equal to the height of said grid tee members.

5. A trim connector as set forth in claim 3 wherein said face portion has a height greater than the height of said grid tee members and is adapted to lock into a channel-shaped trim strip having a height greater than said grid tee members.

6. A trim connector as set forth in claim 3 wherein said face portion provides a planar surface extending perpendicular to said support portion, said trim connector being adapted to mount a trim strip on a grid member in a position substantially perpendicular to such grid member.

7. A trim connector as set forth in claim 2 wherein said face portion provides a planar portion adapted to mount a trim strip on a grid member in a position parallel to such grid member.

8. A trim connector as set forth in claim 7 wherein said trim connector is formed of a single piece of sheet metal bent to provide spaced and parallel legs, each leg providing mounting edges structured to fit along the top and sides of the bulb of an associated grid tee member.

9. A trim connector as set forth in claim 8 wherein said edges are adapted to fit under one side of said bulb and the portions adapted to fit along the remote side of said bulb are provided by bendable tabs which are bent down along the said remote side after said trim connector is positioned on a grid tee member.

10. A trim connector as set forth in claim 2 wherein said face portion is connected to said support portion for pivotal movement between positions perpendicular to said support portion and parallel to said support portion, said trim connector being adapted to mount trim strips extending parallel to said grid members and at angles relative thereto.

11. A trim connector as set forth in claim 10 wherein a pivot element connects said support portion and said face portion.

12. A suspension ceiling trim connector for mounting elongated trim strips on grid tee members along exposed edges of ceiling grids formed of interconnected elongated grid tee members having a central web, opposed panel supporting flanges along one edge of said web, and a stiffening bulb along the opposite edge of said web, said connector comprising a support portion adapted to be secured to said bulb, a face portion providing ends adapted to lock into elongated trim strips, and a pivot connecting said support portion and face portion, said face portion being pivotally moveable relative to said support portion to align said face portion with trim strips extending in a variety of directions relative to a supporting grid tee member.

13. A trim connector as set forth in claim 12 wherein said support portion has an inverted "U" shape and is sized to engage the top and sides of the bulb of an associated grid tee member.

14. A trim connector as set forth in claim 13 wherein said support portion extends from said inverted "U" shape portion permitting said end connector to be mounted at intersections of said grid members.

15. A trim connector as set forth in claim 14 wherein said face portion provides a planar portion and a lateral portion, said pivot connecting said lateral portion to said support portion.

16. A trim connector as set forth in claim 15 wherein said pivot is spaced from said planar portion by a distance at least substantially equal to the width of one of said flanges.

17. A trim connector as set forth in claim 16 wherein said planar portion has a length greater than the height of said grid tee members, and said lateral portion extends from said planar portion intermediate its ends.

18. A trim connector as set forth in claim 12 wherein said face portion provides lateral flanges at the ends thereof operable to lock into a channel-shaped trim strip.

19. A trim connector as set forth in claim 18 wherein at least one of said flanges provides a recess permitting insertion of a tool to release said one flange from a mounted trim strip when demounting of said trim strip is required.

20. A suspension ceiling comprising a grid of interconnected elongated grid tees cooperating to define panel openings, said ceiling providing an exposed edge along at least one portion thereof spaced from an adjacent wall, said grid tees including a central web, a stiffening bulb along one edge of said web and oppositely extending flanges along the opposite edge of said web, connector clips mounted on said grid at intervals along said exposed edge, said connector clips each having a support portion mounted on an adjacent bulb and a face portion, and elongated trim strips connected to said face portions without exposed fasteners, said strips providing a finished exposed trim along said exposed edges, at least some portions of said trim strips extending between adjacent connector clips at an angle relative to the grid tees on which said adjacent connector clips are mounted.

21. A suspension ceiling as set forth in claim 20 wherein at least some of said trim strips are curved.

22. A suspension ceiling as set forth in claim 20 wherein at least some of said trim strips are straight and extend parallel to adjacent grid tees.

23. A suspension ceiling as set forth in claim 20 wherein said support portion engages the top and opposite side walls of said adjacent bulb.

24. A suspension ceiling as set forth in claim 20 wherein said support portion and face portion are connected for relative pivotal movement.

* * * * *